United States Patent [19]

Hirao

[11] Patent Number: 4,662,420

[45] Date of Patent: May 5, 1987

[54] PANEL SHUTTER MECHANISM

[75] Inventor: Masato, Hirao, Tokyo, Japan

[73] Assignee: Sanwa Shutter Corporation, Tokyo, Japan

[21] Appl. No.: 503,144

[22] PCT Filed: Oct. 1, 1982

[86] PCT No.: PCT/JP82/00395

§ 371 Date: May 26, 1983

§ 102(e) Date: May 26, 1983

[87] PCT Pub. No.: WO83/01271

PCT Pub. Date: Apr. 14, 1983

[30] Foreign Application Priority Data

| | | | |
|---|---|---|---|
| Oct. 5, 1981 | [JP] | Japan | 56-159028 |
| Apr. 10, 1982 | [JP] | Japan | 57-52423[U] |
| Apr. 10, 1982 | [JP] | Japan | 57-52424[U] |
| Apr. 10, 1982 | [JP] | Japan | 57-52425[U] |

[51] Int. Cl.[4] ..... E06B 9/26

[52] U.S. Cl. ..... 160/32; 160/133

[58] Field of Search ..... 160/32, 201, 209, 207, 160/214, 224, 35, 33, 37, 175, 133, 218, 233, 234; 292/1

[56] References Cited

U.S. PATENT DOCUMENTS

| | | | |
|---|---|---|---|
| 405,450 | 6/1889 | Wilson | 160/133 |
| 2,586,561 | 2/1952 | Poggi | 160/33 |
| 2,729,287 | 1/1956 | Goldner | 160/33 |
| 2,897,886 | 8/1959 | Pistelli | 160/33 |
| 3,732,913 | 5/1973 | Wrono | 160/133 |

FOREIGN PATENT DOCUMENTS

| | | | |
|---|---|---|---|
| 2703512 | 8/1978 | Fed. Rep. of Germany | 160/33 |
| 112012 | 3/1940 | Sweden | 160/37 |

*Primary Examiner*—Ramon S. Britts
*Assistant Examiner*—David M. Purol
*Attorney, Agent, or Firm*—Fred Philpitt

[57] ABSTRACT

This invention relates to a panel shutter mechanism for covering and uncovering the opening of a building, wherein in one position the panels constituting the shutter are arranged in the same plane so as to cover the opening when each of the panels is supported by guide rails uprightly placed on both edges of the opening, and the panels locked in place by a locking mechanism, and in the other position the panels are rolled up so as to leave the opening uncovered, wherein each of the panels is housed side-by-side in a housing located above the upper ends of the guide rails.

11 Claims, 29 Drawing Figures

PANEL SHUTTER MECHANISM

1. Technical Field

This invention relates to an uplifting type panel shutter mechanism for covering and uncovering the opening of a building, wherein panels constituting a shutter are arranged on the same plane so as to cover the opening when each of the panels is supported by guide rails uprightly placed on both edges of the opening, whereas the panels are rolled up so as to leave the opening uncovered, when each of the panels is housed side by side in a case linked with the upper ends of the guide rails.

2. Background Art

The most popular conventional uplifting type shutter mechanism comprises shutters, or a number of slats linked together in a manner that they are rotatable; a shaft for rolling up the shutters, the shaft being rotatably installed in the shutter housing provided on the upper edge of the opening of a building; and guide rails fixed on the left and right edges of the opening for guiding the shutters upwardly and downwardly. In that mechanism, the shutters are rolled up on the shaft to uncover the opening and, to cover the opening, the shutters are allowed to move downward by their own weight.

However, because the slats constituting a shutter are normally long steel strips linked together by means of members formed at their ends adjacent to each other in the vertical direction for engaging the slats in such a manner that the slat is allowed to turn by a preset angle, the disadvantage is that unpleasant sound is produced by sliding friction and collision between the slats and between the slats and the guide rails, the friction and collision being caused by the members which turn when the shutters are moved upward and downward.

For the above reason, a proposal has been made for providing an uplifting type shutter mechanism which can move a shutter upward and downward by causing each of the slats constituting the shutter to slide on another slat adjacent thereto in order to eliminate such unpleasant sound produced by the uplifting type shutter mechanism when the shutter is moved upward and downward. The disadvantage of this slide type shutter mechanism is that it requires a special mechanism for transferring and displacing the slats, the mechanism being composed of plate-like guide members provided at both ends of each slat, a doglegged link for linking the slats adjacent to each other through a pin in a slit made in the guide member in such a way that the slat is rotatable, and a press roller provided within the channel where the doglegged link moves so as to force the slats from the guide rails into a case for containing the shutter in the direction of rails attached to the case for the slats to hang on, in order to uncover the opening by making each slat slide on another slat adjacent thereto along the guide rails from the position where the slats have been arranged on the same plane to another position where they are vertically placed side by side along the rails attached to the above case for the slats to hang on, or to cover the opening by letting the slats slide down from the position where they have been vertically placed in parallel in the case for containing them to another position where they are arranged on the same plane along the guide rails, that is, in order to put up and down the shutter. Another disadvantage is originated from the very complicated construction of the mechanism for transferring and displacing the slats, which makes it difficult to smoothly operate the shutter upwardly and downwardly.

In addition, a lock with which the conventional slide type shutter is equipped is manually fastened by causing a latch fixed to one of the slats constituting the shutter to fall into and to be lifted from a catch attached to the guide rail, or electrically operated by a solenoid mechanism. Consequently, if it is forgotten to manually lock the shutter in the case of the former, capability of closing an opening as the essential function of a shutter will be lost, causing crime prevention ineffective. In the case of the latter, since a special device such as a solenoid must be installed, it is disadvantageous that troublesome fitting work including wiring is required on the one hand, and that the mechanism itself becomes costly on the other.

In addition, the slide type shutter of this kind, if it is used to cover the whole area of an opening in the daytime according to the necessity of living or working, will interrupt the ventilation and lighting of the building and furthermore deteriorate living and working environments therein; in other words, such shutters are not desirous.

An object of the present invention is accordingly to provide a panel shutter mechanism free from the above mentioned disadvantages characteristic of slide type shutter mechanisms of the prior art and its principal object is to smoothly make the upward transfer of each panel along guide rails up to the horizontal transfer of the panels along rails fixed to a case for containing the shutter, or the horizontal transfer of the panels along the rails fixed to the case up to the downward transfer of them along the guide rails without particularly requiring a mechanism for transferring and displacing the panels when moving the shutter upward and downward.

Another object of the present invention is to provide a panel shutter mechanism capable of automatically locking and unlocking the shutter interlockingly with the operation of the mechanism for opening and closing the shutter.

Still another object of the present invention is to provide a panel shutter mechanism capable of maintaining ventilation and lighting within a building in preferred conditions and securing pleasant living as well as working environments even if the shutter is used to cover the whole area of an opening in the daytime, depending on the living and working condition.

DISCLOSURE OF INVENTION

The shutter according to the present invention is so constructed that a plurality of panels linked together serially through roller chains in the vertical direction at the longitudinal ends of the panels with predetermined spacing between them. To the upper ends of the guide rails for guiding each of the panels constituting the shutter upwardly and downwardly on the same plane, a case for containing the shutter is attached which is equipped with rails for guiding and containing the panels successively in the horizontal direction in such a state that they are placed in parallel rows. Guide sprockets engaging with the above roller chains are rotatably provided in the case for containing the shutter. Thus it is unnecessary to particularly install a mechanism for transferring and displacing the panels and whereby the upward and downward transfer of each panel along the guide rails and its horizontal transfer along the rails for the panel to hang on can be made simultaneously by turning the sprockets only when the shutter is moved upward and downward. In this case, since the panels are linked with each other vertically through the roller chains with predetermined spacing, no collision and sliding friction between the panels will occur when the shutter is moved upward and downward, whereas unpleasant sound is hardly produced; this makes it possible to smoothly put up and down the shutter in good condition.

Moreover, rotatable latches are provided on the upper side surfaces at the left and right ends of selected one of the panels constituting the shutter in such a way that the latches engage with catches fixed to the guide rails only when the shutter is moved downward to cover the opening, whereas locking members are provided on the lower side surfaces at the left and right ends of another panel upwardly adjacent to the panel equipped with the latches so as to prevent the latches from turning when the shutter has been moved down. The shutter mechanism thus constructed permits the shutter to be automatically on and off the latch interlockingly with the operation of the mechanism for folding and unfolding the shutter.

Since the above-mentioned panels constituting the shutter are linked together in series through the roller chains with predetermined spacing between them, if the shutter is employed to cover the whole area of the opening by allowing the vertical spacing between the panels to be maintained according to the living and working condition in the daytime, the gaps formed of the spacing even when the shutter is used to cover the opening can maintain the ventilation and lighting within the building satisfactory and make available pleasant living and working environments.

BEST MODE FOR CARRYING OUT THE INVENTION

Figure 1:
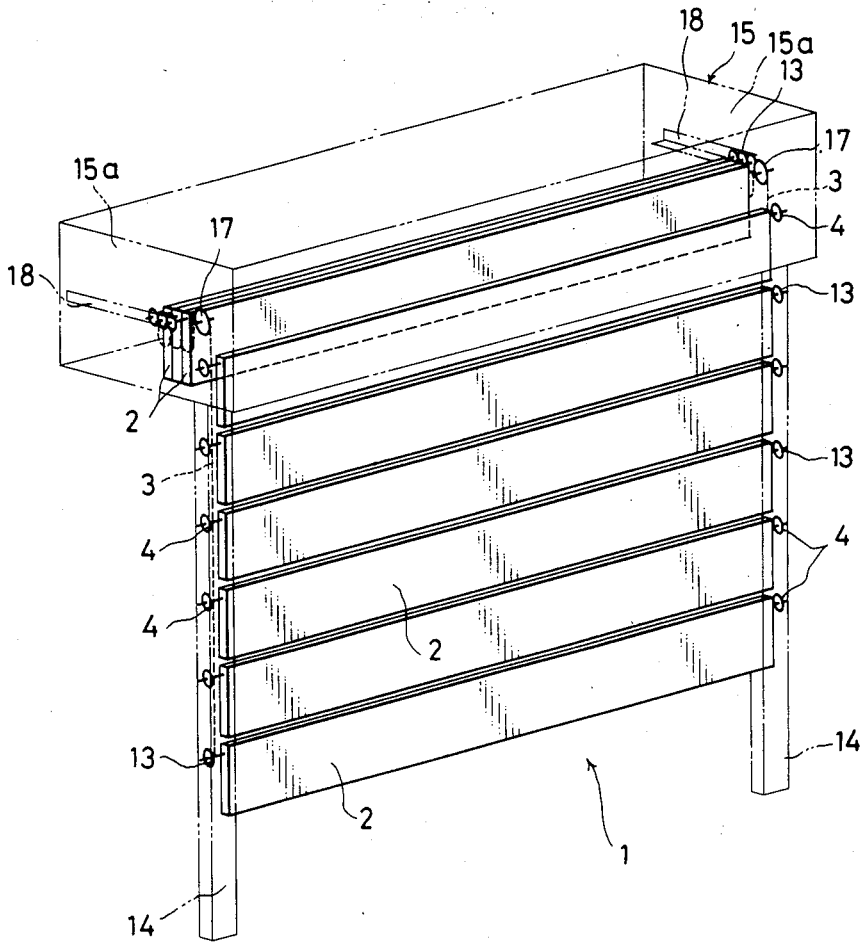
FIG. 1 is a schematic perspective view of a panel shutter mechanism.

Referring now to the drawings attached, the present invention is described in detail as follows.

FIGS. 1 through 7 illustrate one preferred embodiment of the present invention, wherein there is shown a shutter 1 employed to cover and uncover the opening of a building, the shutter 1 comprising a plurality of panels 2, 2 . . . serially linked together and connected to roller chains 3, 3 through connecting members 4, 4 . . . , with predetermined spacing provided between them in the vertical direction, the roller chains being arranged at the ends of the panels in the longitudinal directions (see FIG. 1).

Each of the panels 2, 2 . . . is made in a longitudinal shape and its upper end of the upper frame 5 in the longitudinal direction is provided with an indented frame 5*a* over the whole region of the upper end, whereas the lower end of the lower frame 6 is provided with a recessed frame 6*a* tightly engaging with the above indented frame 5*a*. In addition, glass 8 is vertically fastened in parallel with the surface plate of the panel 2 in between the upper frame 5 and lower frame 6 via a suitable holding member 7 (see FIG. 3).

Figure 2:
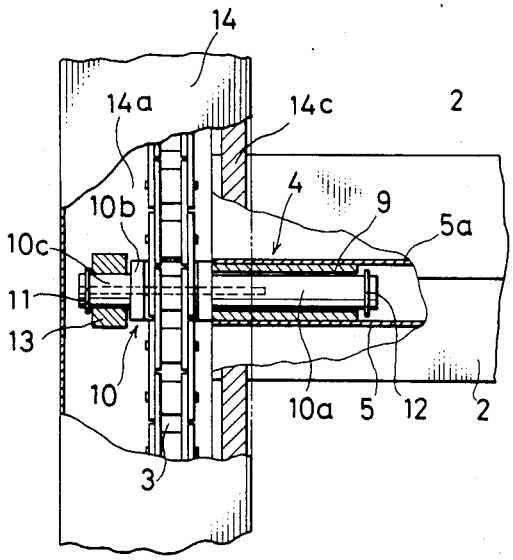
FIG. 2 is a longitudinal sectional front view of the partially cutaway principal part.
Figure 4:
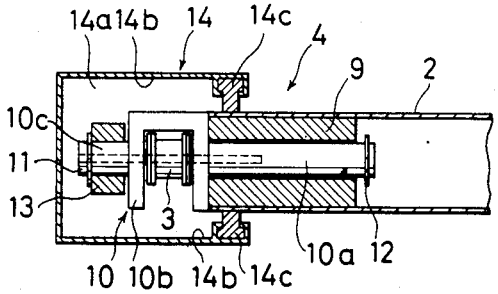
FIG. 4. is a longitudinal sectional plan view of the partially cutaway principal part.
Figure 5:
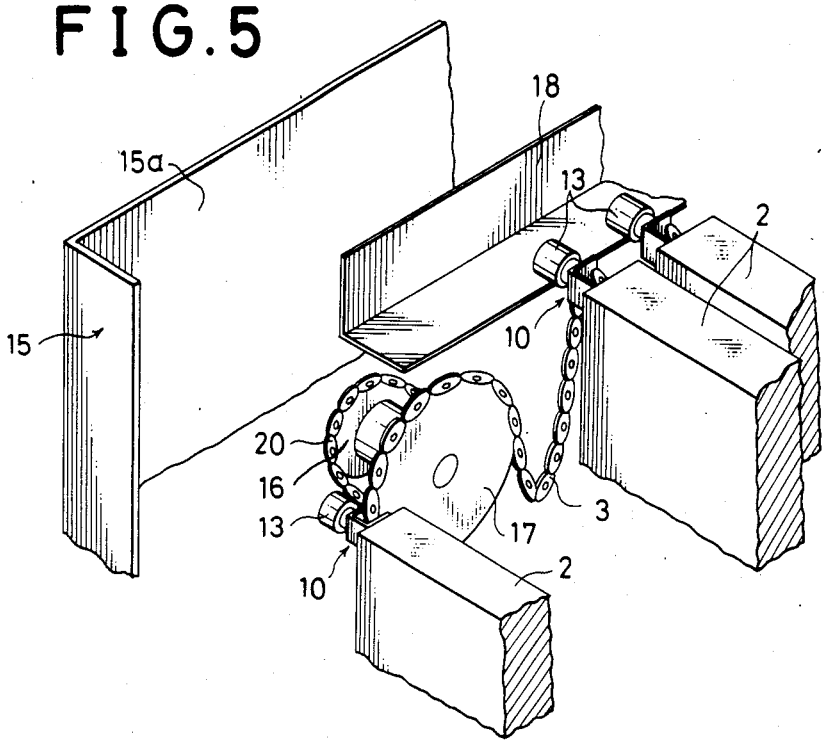
FIG. 5 is a schematic perspective view of the principal part of a first example.
Figure 6:
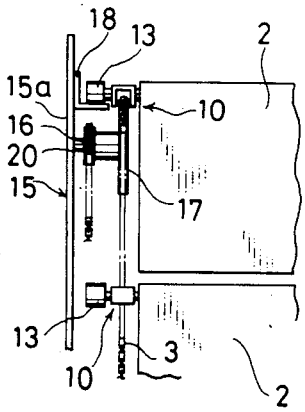
FIG. 6 is a schematic front view of the principal part of the first example.
Figure 7:
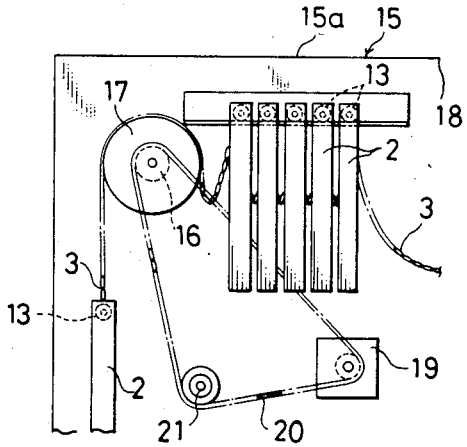
FIG. 7 is a block diagram illustrating a driving mechanism of the first example.

Moreover, each of the connecting members 4, 4 . . . comprises a shaft 10*a* that can be rotated and slid in the axial direction of a cylindrical bearing 9 forced from both ends of each panel 2, 2 . . . in the longitudinal direction in between the upper frame 5 and the indented frame 5*a*; a U-shaped holder 10*b* located at the external end of the shaft 10*a* and used to hold the ring plate of the roller chain 3 from both directions to which the roller chain 3 moves; a roller chain holder composed of a roller bearing 10*c* formed in the axial direction of the shaft 10*a*; a pin 11 for linking the roller chain holder 10 with the roller chain 3; and a stopper pin 12 attached to the internal end of the shaft 10*a* (see FIGS. 2 and 4). However, the above-mentioned connecting member 4 is limited to what has been shown in the drawings, provided that a plurality of panels 2, 2 . . . are linked together serially at both their ends through roller chains 3, 3, with predetermined spacing between them. A roller 13 is rotatably supported by the roller bearing 10*c*.

In a guide rail 14 vertically provided on the left and right edges of the opening of a building, a window and the like, a guide groove 14*a* for guiding the shutter 1 upward and downward is formed. Control members 14*c*, 14*c* for controlling the shutter 1 in the longitudinal direction are inwardly projected on the opening side of the facing surfaces 14*b*, 14*b* of the guide groove 14*a*.

Figure 15:
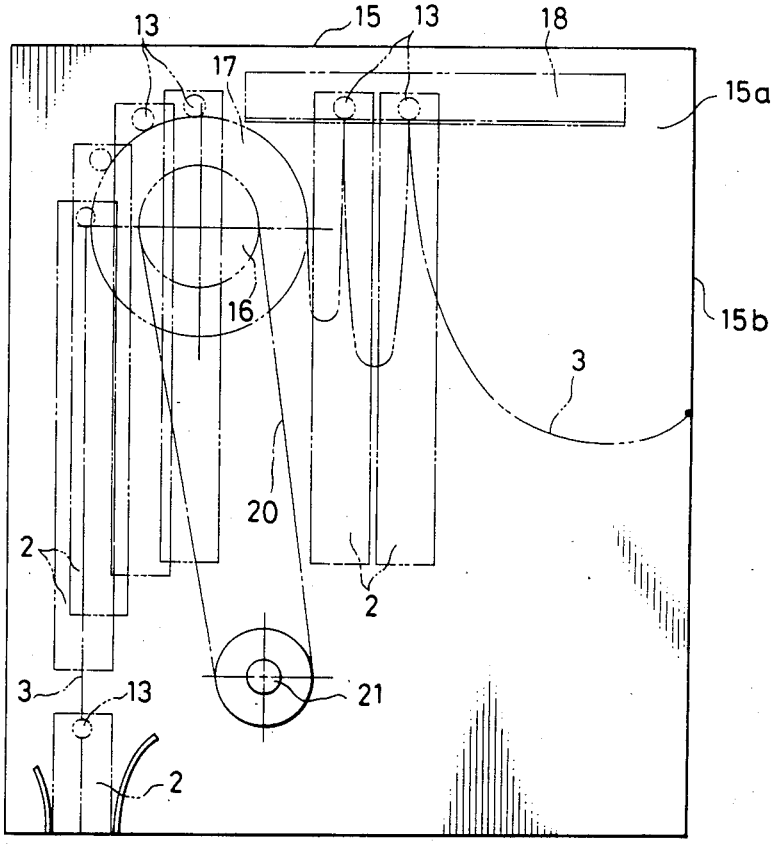
FIG. 15 is a diagram explanatory of the operation of each of the above examples.

There is also shown a case 15 for housing the shutter, the case being linked with the upper ends of the guide rails 14. Guide sprockets 17, 17 concentrically connected to cantilever driving sprockets 16, 16 are provided on the inside facing left and right walls 15*a*, 15*a* of the case for housing the shutter. By engaging part of the roller chains 3, 3 with the guide sprockets 17, 17, the shutter 1 is suspended along the guide rail 14. The extra part of the roller chain 3 may be used as a free end or otherwise it may be supported by the bottom of the case 15 for housing the shutter as shown in FIG. 15. Although arrangements shown (in FIGS. 5 and 6) have been made so as to prevent the roller 13 from contacting the driving sprocket 16 when the panel 2 is moved upward and downward between the upper end of the guide rail 14 and the case 15 for housing the shutter by making the diameter of the driving sprocket 16 smaller than that of the guide sprocket 17 and locating the former in the case 15 for housing the shutter, in order to smoothly move the shutter 1 upward and downward, such arrangements for preventing the roller 13 from contacting the driving sprocket 16 are not restricted to those shown in the drawings as described later. Rails 18 are used to hang the panels and horizontally fixed to facing side walls 15*a*, 15*a* of the case for housing the shutter. The rail 18 acts as a support as the guide sprocket 17 rotates to move and guide each panel 2 in the horizontal direction by rotating the roller 13 of the panel 2 transferred upward. To the extent that the above rail 18 is capable of moving and guiding the panel 2 in the horizontal direction, it should not always be horizontally fixed as shown in the drawing but attached in such a way that its transferring direction is slightly inclined downwardly. A switch gear 19 is installed within the case 15 for housing the shutter and interlockingly connected to the driving sprocket 16 via an endless belt 20 and an interlocking shaft 21.

The panel shutter thus constructed according to the present invention causes each of the panels 2 constituting the shutter 1 to be arranged on the same plane when they are supported by the guide rails 14 and to be placed vertically side by side when they are supported by the rails 18 in the case 15 linked with the upper ends of the guide rails 14 for housing the shutter.

Figure 8:
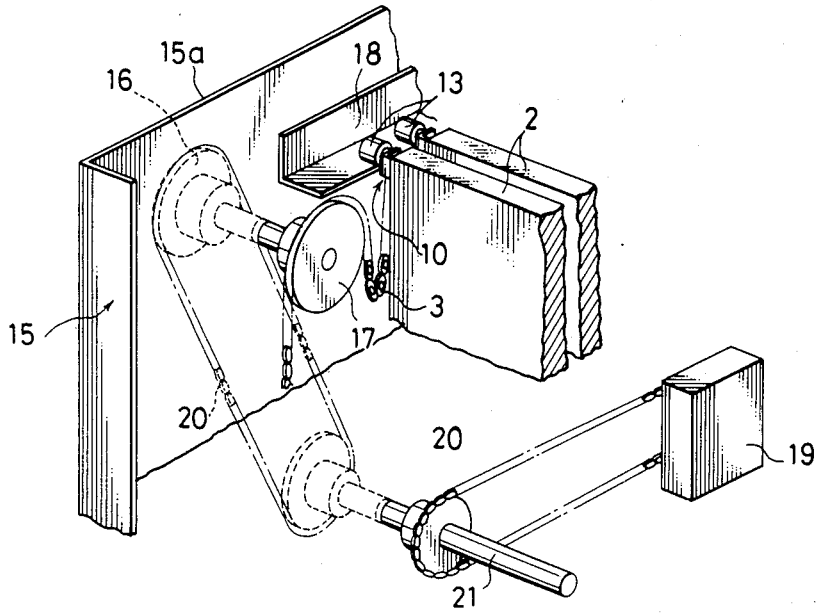
FIG. 8 is a schematic perspective view of the principal part of a second example.
Figure 9:
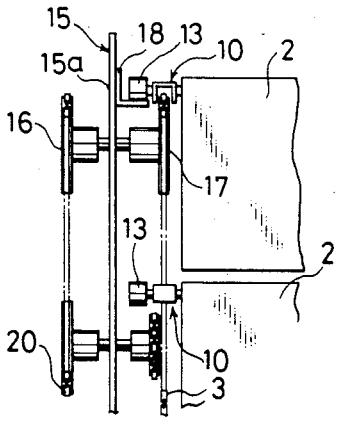
FIG. 9 is a schematic front view of the principal part of the second example.
Figure 10:
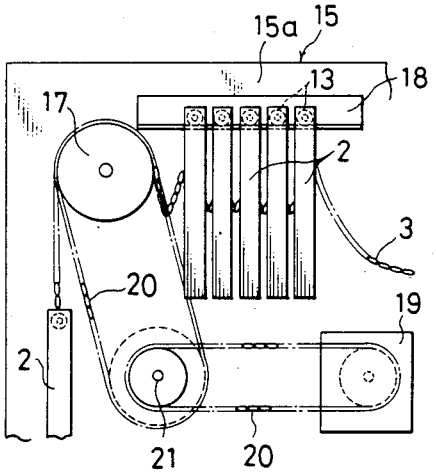
FIG. 10 is a block diagram illustrating a driving mechanism of the second example.

FIGS. 8 through 10 illustrate a second example of the present invention, wherein the difference between the first and second examples lies in arrangements for preventing the roller 13 from making contact with the driving sprocket 16. It constitutes the feature of the second example that the diameters of the driving sprocket 16 and the guide sprocket 17 concentrically supported are made identical and that the driving sprockets 16 are attached to the facing left and right outside walls 15*a*, 15*a* of the case 15 for housing the shutter. Other arrangements including the construction of the shutter 1, the mechanism of power transmission from the switch gear 19 to the driving sprocket 16 and so on are the same as those shown in the first example.

Figure 11:
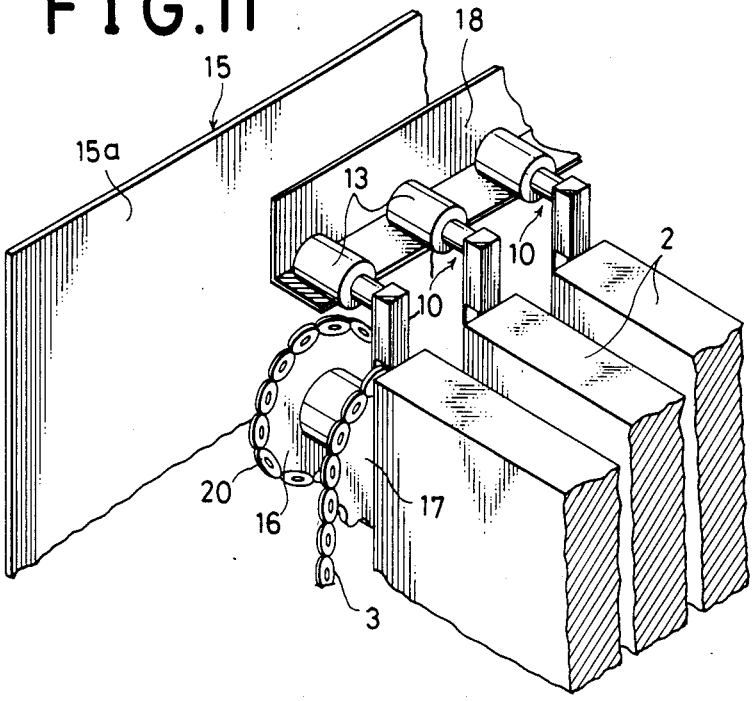
FIG. 11 is a schematic perspective view of the principal part of a third example.
Figure 12:
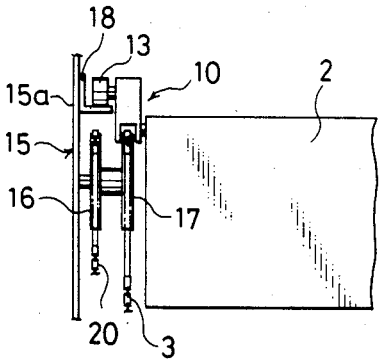
FIG. 12 is a schematic front view of the principal part of the third example

FIGS. 11 and 12 illustrate a third example of the present invention, wherein it constitutes the feature of this example that, for preventing the roller 13 from contacting the driving sprocket 16, the diameters of the guide sprockets 17 are made identical with those of the concentric cantilever driving sprockets 16 located on the facing left and right inside walls 15*a*, 15*a* of the case 15 for housing the shutter and that the roller bearing is located above the shaft of the roller chain holder 10 forming the connecting member 4.

Figure 14:
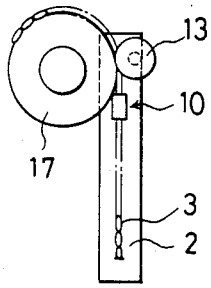
FIG. 14 is a schematic side view of the principal part of the fourth example.
Figure 13:
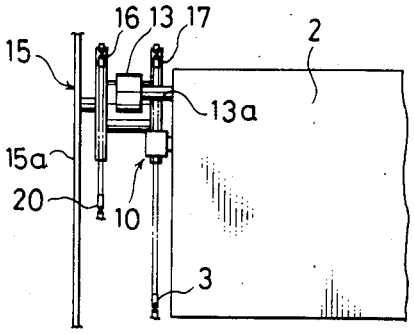
FIG. 13 is a schematic front view of the principal part of a fourth example.

FIGS. 13 and 14 illustrate a fourth example of the present invention, wherein the difference between this example and the first, second and third examples exists with regard to the arrangements for preventing the roller 13 from contacting the driving sprocket 16. It constitutes the feature of the fourth example that the diameters of the guide sprockets 17 are made identical with those of concentric cantilever driving sprockets 16 located on the facing left and right inside walls 15*a*, 15*a* of the case 15 for housing the shutter, that the connecting member 4 for serially linking each of the panels 2 with the roller chain 3 and the support 13*a* of the roller 13 rolling on the rail 18 are separately constructed and that the support 13*a* of the roller 13 is located above the connection of the connecting member 4. In the arrangements, when the panel 2 moves upward and downward along the guide rail 14, the connecting member 4 is made to share the load of the panel 2, whereas the roller support 13*a* is allowed to share the load when the panel 2 horizontally moves along the rail 18 for the panel to hang on.

Figure 16:
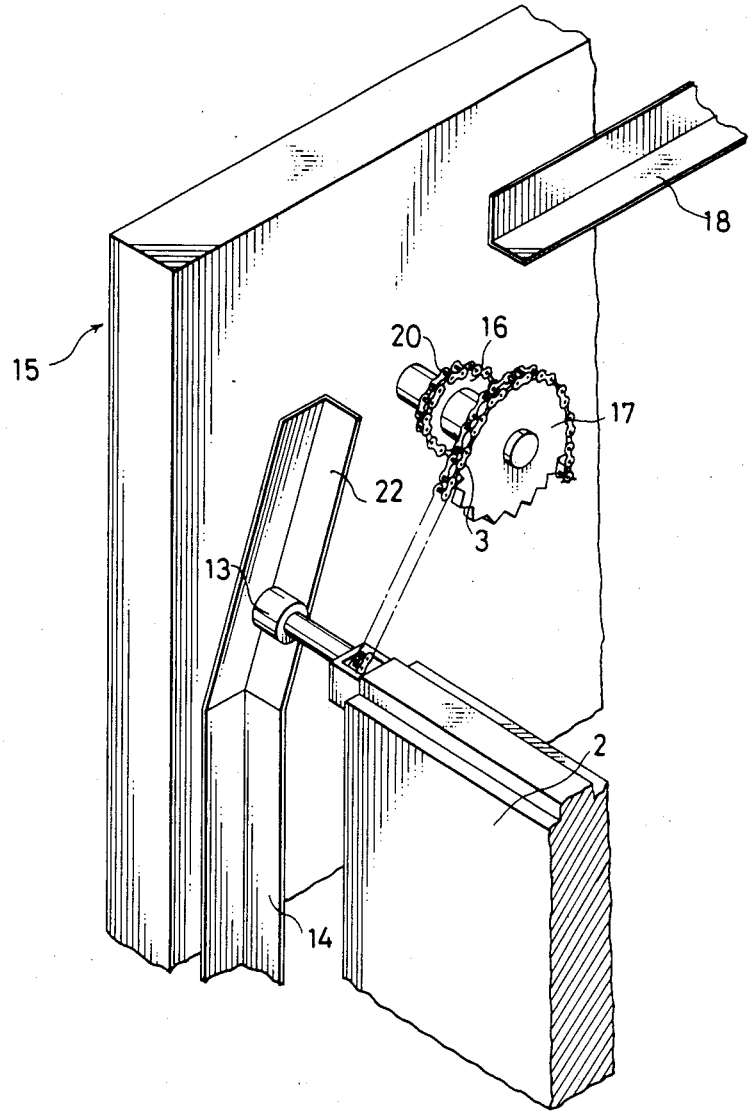
FIG. 16 is a schematic perspective view of the principal part of a fifth example.
Figure 17:
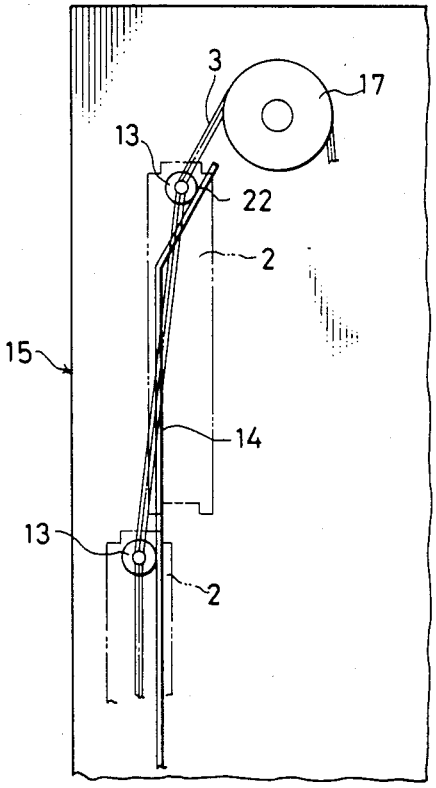
FIG. 17 is a diagram explanatory of the operation of the fifth example.

FIGS. 16 and 17 illustrate a fifth example of the present invention, wherein the upper end of the guide rail 14 is extended and upwardly inclined in the transverse direction of the rail 18 for the panel to hang on in the case 15 for housing the shutter and an inclined relay channel 22 is provided between the upper end of the guide rail 14 and the guide sprocket 17 for rolling the roller 13.

Figure 18:
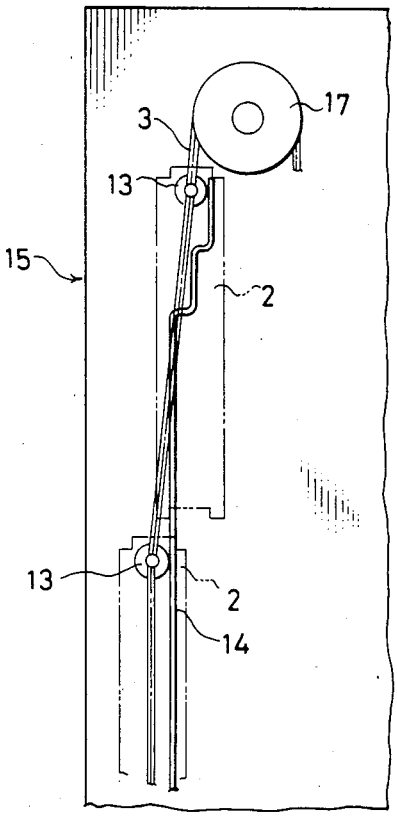
FIG. 18 is a diagram explanatory of the operation of a sixth example.

FIG. 18 illustrates a sixth example of the present invention, wherein, when the upper end of the guide rail 14 is extended and upwardly inclined in the transverse direction of the rail 18 for the panel to hang on in the case 15 for housing the shutter, the upper end of the guide rail 14 is bent toward the case 15 for housing the shutter beforehand, and the extended portion is upwardly extended so as to form a tiered relay channel 23 between the upper end of the guide rail 14 and the guide sprocket 17 for rolling the roller 13.

Figure 19:
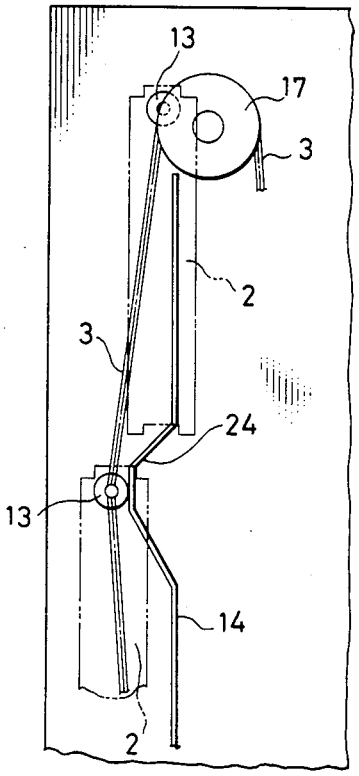
FIG. 19 is a diagram explanatory of the operation of a seventh example.

FIG. 19 illustrates a seventh example of the present invention, wherein an auxiliary rail 24 for guiding upward and downward the panel 2 which has moved upward and downward along the guide rail 14 by making the panel skirt round the outside of the locus of its upward and downward movement is connected to the upper end of the guide rail 14 in order to form an inclined relay channel between the upper end of the guide rail 14 and the guide sprocket 17.

Figure 20:
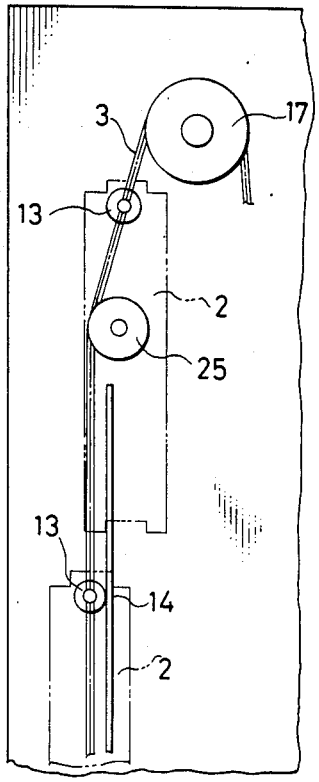
FIG. 20 is a diagram explanatory of the operation of an eighth example.

FIG. 20 illustrates an eighth example of the present invention, wherein an auxiliary sprocket 25 for outwardly pressing the roller chain 3 engaging with the guide sprocket 17 is provided between the upper end of the guide rail 14 and the guide sprocket 17 and an inclined relay channel is formed by the roller chain 3 via this auxiliary sprocket 25.

For the fifth through eighth examples, even if the shutter 1 is moved upward and downward at high speed and even if each panel 2 is moved upward and downward at high speed, the panel will not affected by the action of sharply changing the direction when the direction of the movement is changed, because each of the panels 2 constituting the shutter 1 is moved along the inclined relay channel during the time that the panel moves from the upper end of the guide rail 14 up to the guide sprocket 17 in the process of its upward movement, and during the time that the panel moves from the guide sprocket 17 up to the upper end of the guide rail 14. Accordingly, it is featured that the upper panel is prevented from contacting the lower one and that the shutter can be smoothly moved upward and downward even at high speed.

Figure 21:
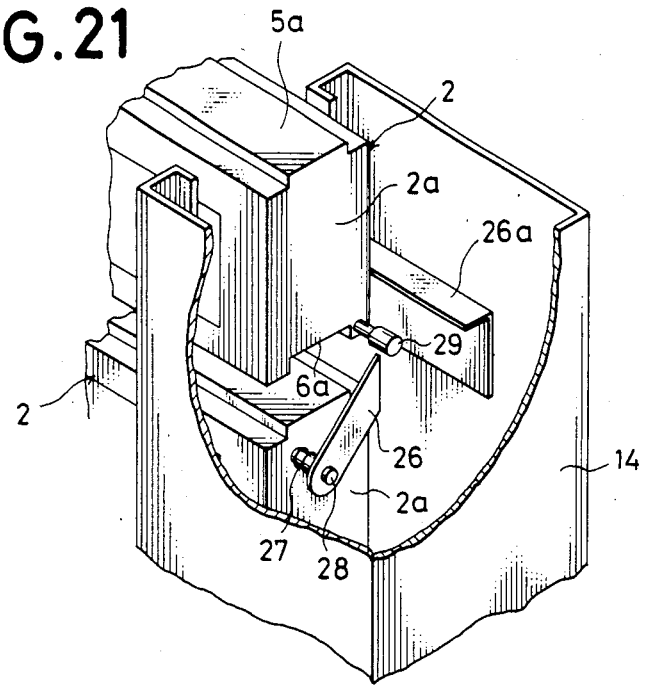
FIG. 21 is a perspective view of a partially cutaway lock mechanism.
Figure 22:
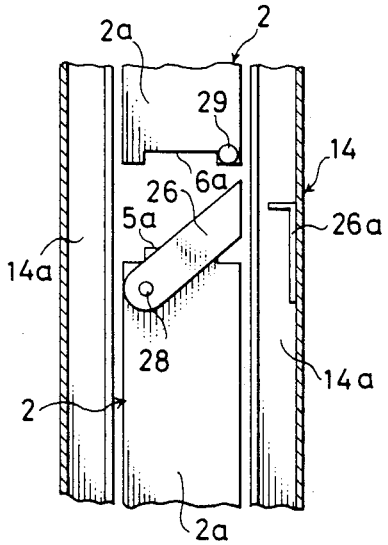
FIG. 22 is a diagram explanatory of the released
Figure 23:
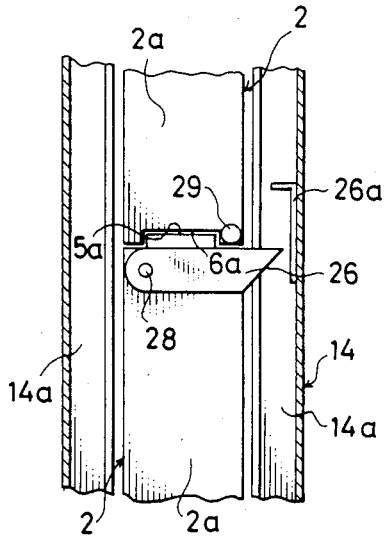
FIG. 23 is a diagram explanatory of the fastened lock.

FIGS. 21 through 23 show an example of a lock mechanism according to the present invention. The upper sides of the left and right end surfaces 2*a* of a panel 2 selected from those adjacent to each other vertically are provided with the bases of latch claws 26 which fall into L-shaped catches 26*a* provided in guide grooves 14*a* of the guide rails 14 only when the shutter 1 is closed, the bases being held by holders with twist springs 27 in such a way that the bases are vertically rotatable.

At the lower ends of the left and right end surfaces of the panel 2 located above and adjacent to the panel 2 provided with the latch claws 26, press pins 29 are projected so as to make the tips of the latch claws 26 project from the side surfaces 2*a* of the panel 2 into the guide grooves 14*a* after being made to contact the upper edge of the latch claws 26 to cause the tips to engage with the catches 26*a* when the panel 2 is moved downward.

Figure 24:
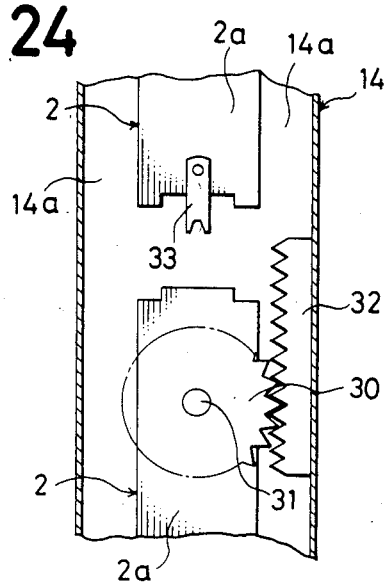
FIG. 24 is a side view illustrating another lock. example of a lock mechanism.

FIG. 24 illustrates another example of a lock mechanism, wherein latches 30 composed of pinion gears are rotatably supported via holding pins 31 at the upper ends of the left and right end surfaces 1*a* of a panel 2 properly selected from the panels 2 adjacent to each other and at the same time racklike catches 32 caused to engage with the latches 30 are provided in the guide grooves 14*a* of the guide rails 14. On the other hand, at the lower ends of left and right end surfaces 2*a* of the panel 2 located above and adjacent to the panel 2 provided with the latches 30, lock members 33 are downwardly projected so as to check the rotation of the latches 30 by engaging with the teeth of the latches 30 when the panel 2 is moved downward.

Consequently, the lock mechanisms shown in FIGS. 21 through 24 are automatically operated to lock and unlock the shutter 1 when it is moved upward and downward.

Figure 3:
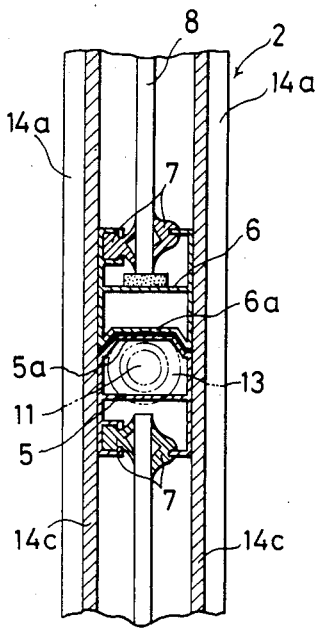
FIG. 3 is a longitudinal sectional side view of the partially cutaway principal part.
Figure 25A:
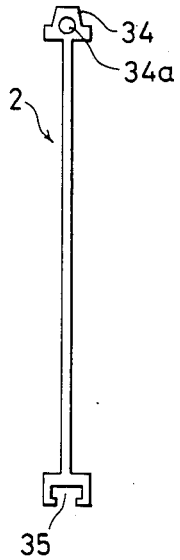
FIGS. 25 (A), (B) are side views of other examples of panels.
Figure 25B:
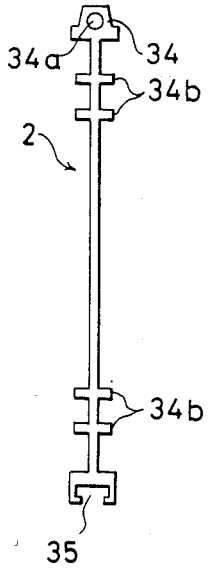
Figure 26A:
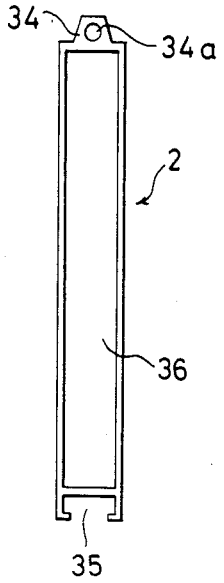
FIGS. 26 (A), (B) are side views of still other examples of panels.
Figure 26B:
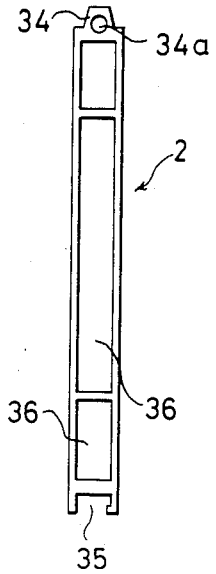

However, the panels constituting the shutter 1 shown in FIG. 3 are not limited to those which are constructed of plate-like members such as glass 8 incorporated into frame bodies consisting of horizontal and vertical frames; for instance, they may be integratedly formed of injection molded material mainly using metal such as aluminum, synthetic resin and the like, or otherwise roll-formed in one body. Moreover, any panels formed in one body through the above means, as shown in FIGS. 25 (A), (B), they may be made into single layer plates or laminated ones shown in FIGS. 26 (A), (B). In other words, in the drawing, there are shown therein an indented portion 34 formed on the upper edge of the panel 2, a fitting hole 34*a* for serially linking the panels with the roller chain 3, a rib 34*b* projected from the surface of the panel 2, a recess 35 made on the lower edge of the panel 2; whereby the recess 35 is used to engage with the indented portion 34 when the shutter 1 is closed in order to maintain the closed condition of the shutter 1. A hollow portion 36 is provided when a compound panel 2 is used.

Figure 27:
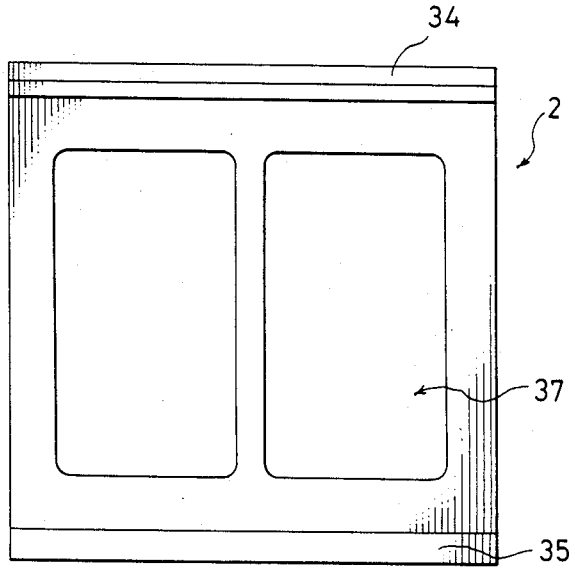
FIG. 27 is a front view of another example of a panel.

FIG. 27 shows still another example of a panel 2, wherein a window 37 is made in the surface of the panel properly selected among those vertically adjacent to each other.

Accordingly, when a monopanel 2 is employed in this example, even if the shutter 1 is used to cover the whole area of the opening, lighting and ventilation in the building can be maintained by providing the panel with a window 37 which can be opened and shut. Moreover, when a compound panel 2 is formed, the hollow portion 36 can be used as a display shelf by attaching a transparent plate to the window 37, thus making it possible to let the shutter 1 demonstrate an advertisment function.

The functions of the mechanism thus constructed according to the present invention are described in reference to the examples 1 through 4 as follows. When the opening is covered with the shutter 1 and shutter 1 is locked, if a signal for releasing the shutter 1 is applied, the motor incorporated in the switch gear 19 will turn in the direction of moving the shutter 1 upward and the driving power will be transmitted to the driving sprocket 16 through the endless belt 20 and the interlocking shaft 21 and whereby the guide sprocket 17 will be turned interlockingly with the rotation of the driving sprocket 16. As a result, the panels linked together by the roller chain 3 engaging with the guide sprocket 17 through the connecting member 4 and arranged on the same plane along the guide rail 14 are moved upward with predetermined spacing vertically maintained. As the panels are moved upward, they are automatically unlocked, whereas the moving direction is gradually changed from the upward to horizontal directions while the connecting member 4 is being transferred along the locus of the rotation of the guide sprocket 17. In addition, at the point of time that the member passes right above the axis of the guide sprocket 17, the roller 13 is relayed onto the rail for the panels to hang on in the case 15 for housing the shutter. As the roller 13 rolls, each of the panels is guided horizontally and contained in such a state that they are placed vertically in parallel with each other (see FIG. 15).

On the other hand, when the shutter 1 is closed, the motor incorporated in the switch gear 19 is turned in the opposite direction, that is, the direction of moving the shutter 1 downward and then each of the panels 2 contained in the case for housing the shutter in the above parallel state are gradually moved in the horizontal direction interlockingly with the rotation of the guide sprocket 17. At the point of time that the the connecting member 4 of the panel 2 located in the frontmost row passes right above the axis of the guide sprocket 17, the moving direction is changed from the horizontal direction to downward one. While the connecting member 4 is being moved along the locus of the rotation of the guide sprocket 17, the panel begins to move downward and it is followed by the next one. When the lower frame 6 of the panel located in the downmost row (frontmost row) sits on the floor, the recessed frame 6*a* formed in the lower frame 6 formed in the panel right above the lowest one is caused to tightly engage with the indented frame 5*a* formed in the upper frame 5 of the lower panel 2. In the same way, each of the panels are supported by the guide rails and arranged on the same plane. Thus the opening is covered with the shutter 1, which is automatically locked.

In this case, during the course of the panel 2 moving upwardly and horizontally, because the roller has been so arranged that it is prevented from contacting the driving sprocket 16, the change of the direction from upward to horizontal movements or from horizontal to downward movements of the panel by means of the guide sprocket 17 interlocking turning with the driving sprocket can be carried out smoothly and precisely.

Subsequently, the functions of the present invention are described by reference to the examples 5 through 8. Although the examples 1 through 4 are proved suitable when the shutter 1 is moved upward and downward at low speed, if the shutter 1 is moved at high speed when necessary, the upper side of the panel 1 will be forced to move interlockingly with the rotation of the guide sprocket 17 in the horizontal direction along the rail 18 for the panel to hang on from the upward direction along the guide rail 14, or in the horizontal direction along the rail 18 to the downward direction along the guide rail 14. However, because the lower side of the panel is set free, it cannot follow the moving direction of its upper side because of inertia and, when the panel changes its direction to move, a movement lag is produced. For this reason, when the shutter 1 is moved upward and when each the panels constituting the shutter 1 changes its direction to move from the upward direction to horizontal one, the upper end of the lower panel 2 collides with the lower side of the upper panel 2. On the other hand, when the shutter 1 is closed and when each of the panels 2 changes its direction to move from the horizontal direction to downward one, the upper end of the front panel 2 collides with the lower side of the following panel 2; thus, the shutter 1 is not moved upward and downward smoothly and accurately.

However, in the case of the examples 5 through 8, as described above, the inclined relay channel is formed between the upper end of the guide rail 14 and the guide sprocket 17 so that each of the panels 2 constituting the shutter 1, when it is moved upward from the upper end of the guide rail 14 to the guide sprocket 17 and when it is moved downward from the guide sprocket 17 to the upper end of the guide rail 14, moves along the inclined relay channel. Therefore, even if each panel is moved up and down at high speed, it is not affected by the sharp change of the direction caused by the rotation of the guide sprocket 17 when the direction is changed. As a result, no movement lag is produced on the lower side of each panel kept free then and the upper panel 2 is prevented from being collided with the lower panel and the shutter 1 can be moved up and down at high speed.

As has been made clear, according to the present invention;

(1) When the shutter 1 is moved up and down, the transfer and displacement of the panels arranged on the same plane along the guide rails 14 to such a state in which the panels are placed side by side along the rail for the panels to hang on in the case 15 for housing the shutter, and the transfer and displacement of the panels placed in parallel with each other in the case 15 for housing the shutter, can be simultaneously carried out by means of the rotation of the guide sprocket 17 engaging with the roller chain 3 simply linking the panels 2 together and a particular transfer and displacing mechanism is unnecessary; thus this makes it possible to simplify the shutter mechanism.

(2) The simplified construction makes small the number of parts and, because the shutter can be moved up and down smoothly without trouble and necessity of high dimensional accuracy at the time of assembly, assembling work is extremely facilitated.

(3) Since the panels 2 are linked together with predetermined spacing between them, no collision and friction between them as well as unpleasant sound are produced, whereas the shutter 1 can be quickly moved up and down.

(4) If the shutter 1 is used to cover the whole area of the opening with the vertical spacing being maintained depending on the living and working condition in the daytime, the ventilation and lighting of the building will be properly maintained through the gaps formed by the spacing and thus pleasant living and working environments can be secured.

(5) When the shutter 1 is moved down, because the recessed frame **6*a* formed in the lower frame 6 of the upper panel 2 or the recessed portion 35 formed in the lower edge of the panel 2 is engaged with the indented frame 5*a* formed in the upper frame 5 of the lower panel 2 or the indented portion 34 formed on the upper edge of the panel 2, the panels 2 arranged on the same plane along the guide rails 14 look as though they were one sheet of panel; consequently, the panels are not subjected to (doglegged) deformation upon receipt of external force and they can be mutually fixed for certain. In addition, the shutter 1 can be locked and unlocked interlockingly with its upward and downward movements, so that no inconvenience in view of crime prevention due to the fact that locking has been forgotten will not occur. Accordingly, the protection of the opening as the essential function of a shutter 1** can be secured completely.

(6) When the panels 2 constituting the shutter 1 are made into compound plates with hollows 36 using metal such as aluminum or injection molded material mainly made of synthetic resin, the hollow portions 36 can be used as shelves for displaying merchandise by providing a window in one of the surfaces and attaching transparent plates to the windows 37. Thus the advertising in addition to protective functions of the shutter 1 can be demonstrated.

Industrial Applicability

The panel shutter mechanism according to the present invention produces no unpleasant sound when the shutter is moved up and down and offers extremely nimble operability on the one hand, and the shutter can be automatically locked and unlocked on the other, this mechanism is highly serviceable for use in shutters covering and uncovering the opening of a building and usable for every building.

What is claimed is:

1. A panel shutter mechanism comprising in combination (a) a plurality of elongated horizontally disposed panels that are disposed parallel to each other, (b) a roller chain arrangement for linking together adjacent ends of said panels in a manner leaving a predetermined space therebetween, (c) guide rails for guiding the panels up and down within a vertical plane, (d) a housing located adjacent the upper portion of said guide rails for receiving and maintaining a horizontal array of panels in a side-by-side relationship, (e) guiding rollers extending outwardly from each end of each elongated panel, (f) generally horizontal rails located in said housing for receiving and supporting said guiding rollers when the panels are maintained in a side-by-side relationship, (g) guide sprockets which engage said roller chains and which are rotatable to move said roller chains upwardly and downwardly, (h) drive sprockets to rotate said guide sprockets, whereby when the guide sprockets are driven in one direction the panels will be positioned one above the other in a substantially vertical plane, and when the guide sprockets are driven in the opposite direction the panels will be disposed side-by-side in a substantially horizontal array, and (i) a locking mechanism associated with adjacent panels to automatically lock all the panels together when the panels are moved downwardly and unlock the panels from each other when the panels are moved upwardly, said locking mechanism comprising latch claws on the upper side of at least one panel, which claws are normally biased into an upper disposition, and press pins on the lower side of the next higher panel which are adapted to press downwardly upon said latch claws when the shutter is in its closed down position, the claws in their down position extending into an obstructing relationship with a portion of the guide rails so that the panels cannot move freely upwardly within the guide rails.

2. A panel shutter mechanism as set forth in claim 1 wherein the guide sprockets and driving sprockets are installed on the same shaft on the left and right inside walls of said housing and the diameter of the driving sprocket is smaller than that of the guide sprocket so that the rollers do not contact the driving sprocket when the panels move upward along the guide rails and then move horizontally along said horizontal rails.

3. A panel shutter mechanism as set forth in claim 1 wherein said guide sprockets are installed on the left and right inside walls of said housing and the driving sprockets are installed on the left and right outside walls of said housing both sprockets being supported on the same shaft, the diameter of the driving sprocket being identical with that of the guide sprocket, and the rollers are prevented from contacting the driving sprocket when the panels move upward along the guide rails and then horizontally along the horizontal rails.

4. A panel shutter mechanism as set forth in claim 1 wherein said guide sprockets and driving sprockets have the same diameter and are installed on the left and right inside walls of said housing and supported on the same shaft, the roller chain and a connecting member supporting the panel are are separately constructed, and each roller is located between the guide sprocket and the driving sprocket so as to prevent the rollers from contacting the driving sprocket when the panels move upward along the guide rails and then horizontally along the horizontal rails.

5. A panel shutter mechanism as set forth in claim 1 wherein the upper end of said guide rails are extended and upwardly inclined in the transverse direction of the horizontal rails, and an inclined relay channel is located between the upper end of the guide rails and the guide sprockets for rolling the rollers.

6. A panel shutter mechanism as set forth in claim 1 wherein the upper end of the guide rails are extended and upwardly inclined in the transverse direction of the horizontal rails and the extended portion is bent in tiers, and an inclined relay channel is located between the upper end of the guide rails and the guide sprockets for rolling the rollers.

7. A panel shutter mechanism as set forth in claim 1 wherein the upper ends of the guide rails are each provided with an auxiliary rail for upwardly moving and guiding each panel as it is moved upward along the guide rails after making the panels outwardly skirt around the locus of elevation once during its uplifting process, and an inclined relay channel is formed between the upper end of the guide rails and the guide sprockets through the auxiliary rails.

8. A panel shutter mechanism as set forth in claim 1 wherein an auxiliary sprocket is provided for outwardly pressing the roller chain engaging with the guide sprocket between the upper end of the guide rails and the guide sprockets and an inclined relay channel is formed by each roller chain through the auxiliary sprocket.

9. A panel shutter mechanism as set forth in claim 1 wherein a window is provided in the panel and a transparent plate is attached to the window in such a way that the window is opened and shut so as to provide the panel with protective function as a shutter and to secure the ventilation and lighting of the building through the window when the opening is covered with the shutter.

10. A panel shutter mechanism as set forth in claim 1 wherein each of the panels is an integrated plate-shaped panel from metal or an injection molded material composed of synthetic resin.

11. A panel shutter mechanism comprising in combination (a) a plurality of elongated horizontally disposed panels, that are disposed parallel to each other, (b) a roller chain arrangement for linking together adjacent ends of said panels in a manner leaving a predetermined space therebetween, (c) guide rails for guiding the panels up and down within a vertical plane, (d) a housing located adjacent the upper portion of said guide rails for receiving and maintaining a horizontal array of panels in a side-by-side relationship, (e) guiding rollers extending outwardly from each end of each elongated panel, (f) generally horizontal rails located in said housing for receiving and supporting said guiding rollers when the panels are maintained in a side-by-side relationship, (g) guide sprockets which engage said roller chains and what are rotatable to move said roller chains upwardly and downwardly, (h) drive sprockets to rotate said guide sprockets, whereby when the guide sprockets are driven in one direction the panels will be positioned one above the other in a substantially vertical plane, and when the guide sprockets are driven in the opposite direction the panels will be disposed side-by-side in a substantially horizontal array, and (i) a lock mechanism including means associated with adjacent panels for automatically locking the shutter when the panels are moved downward and for automatically unlocking the shutter when the panels are moved upward.

* * * * *